United States Patent [19]

Wells et al.

[11] Patent Number: 4,519,985

[45] Date of Patent: May 28, 1985

[54] USE OF ACTIVATED CARBON TO REMOVE DISSOLVED ORGANICS FROM URANIUM LEACHATE

[75] Inventors: Bruce D. Wells, Pittsburgh, Pa.; Du'Bois J. Ferguson, Houston, Tex.

[73] Assignee: Calgon Carbon Corporation, Pittsburgh, Pa.

[21] Appl. No.: 129,540

[22] Filed: Mar. 12, 1980

[51] Int. Cl.[3] ..... C01G 43/00

[52] U.S. Cl. ..... 423/6; 502/416

[58] Field of Search ..... 423/6, 10; 252/444, 252/445, 421

[56] References Cited

U.S. PATENT DOCUMENTS

| | | | |
|---|---|---|---|
| 3,320,033 | 5/1967 | Goren | 423/10 |
| 3,619,161 | 11/1971 | Knarr et al. | 210/44 |
| 4,190,633 | 2/1980 | Smith et al. | 423/8 |

FOREIGN PATENT DOCUMENTS

| | | | |
|---|---|---|---|
| 1027849 | 3/1978 | Canada . | |
| 2278628 | 2/1976 | France | 423/10 |

OTHER PUBLICATIONS

Perry et al., "Chemical Engineers' Handbook", 5th Ed., pp. 16, 4–6 & 10, McGraw-Hill Book Co., (1973), New York.

*Primary Examiner*—Edward A. Miller

*Attorney, Agent, or Firm*—R. Brent Olson; Michael C. Sudol; William C. Mitchell

[57] ABSTRACT

Use of activated carbon having a net pore volume of at least 0.40 cc./gram for those pores having a pore diameter of from 35 to about 1000 Å to remove dissolved organic components from a uranium leachate solution.

1 Claim, No Drawings

USE OF ACTIVATED CARBON TO REMOVE DISSOLVED ORGANICS FROM URANIUM LEACHATE

This invention relates to an in-situ uranium leaching process.

More particularly, this invention relates to the use of activated carbon to remove dissolved organic components from a uranium leachate solution.

In-situ leach mining may be generally defined as a selective mining technique whereby the ore mineral is preferably leached or dissolved from the surrounding host rock by the use of specific leach solutions and the minerals recovered. In-situ uranium leach mining consists of injecting a suitable leach solution into the ore zones below the water table; oxidizing, complexing and mobilizing the uranium; recovering the uranium containing solution through production wells; and pumping the uranium containing solution to the surface for further processing. The uranium containing solution will often contain a variety of dissolved organic compounds which must be removed prior to recovery of the uranium.

We have discovered that granular activated carbon having a net pore volume of at least 0.40 cc./gram for those pores having a pore diameter of from 35 to about 1000 Å may be utilized to selectively remove the dissolved organics from the uranium containing leachate solution without removing any substantial quantity of uranium from the leachate. A more preferred activated carbon has a net pore volume of 0.44 cc./gram for those pores having a pore diameter of from 35 to 1000 Å. In use, the uranium containing leachate is passed through a bed of granular activated carbon.

Such granular activated carbons show an increase in capacity when evaluated in a test in which the adsorption isotherms are calculated.

The adsorption isotherm shows the distribution of adsorbate between the adsorbent and solution phases. It is a plot of the amount of impurity adsorbed from solution versus the amount of impurity remaining in solution at constant temperature. For single components, a straight line plot can be obtained when using the empirical Freundlich equation:

$$\frac{x}{m} = kc^{1/n} \text{ or } \log\frac{x}{m} = \log k + \frac{1}{n}\log c$$

where x=amount of contaminant adsorbed;

m=weight of carbon;

c=equilibrium concentration in solution after adsorption; and k and n are constants.

Data for plotting this type of isotherm are obtained by treating fixed volumes of the water sample with a series of known weights of carbon. Also, a blank sample is tested under the same conditions. The carbon-liquid mixture is agitated for one hour at a constant temperature. After the carbon has been removed by filtration, the residual contaminant concentration is then determined. The amount of solute adsorbed by the carbon (x) is divided by the weight of carbon in the sample (m) to give one value of x/m for the isotherm. In this test, a one liter sample of leachate was used to conduct the characterization and isotherm tests.

Each five point isotherm for Carbons A and B was set up using a 50 ml. sample for the low carbon dosages and a 150 ml. sample for the high carbon dosage. A single control was used for all of the isotherm testing. All of the SOC results in the isotherm test ere normalized to grams/500 ml. for the sake of convenience.

The SOC adsorption capacities for Carbon A and Carbon B were 94.8 mg. SOC/grams and 263.6 mg. SOC/grams respectively, as set forth in Tables 1 and 2, were calculated using linear regression.

Analyses were conducted on the leachate and the high carbon dosage (5 g./liter). These analyses are shown in Table 3.

As shown in Table 3, molybdenum is the only metal present in substantial quantity, and is not reduced by carbon treatment. The selenium is reduced somewhat from 2.2 mg./liter, and all other metals tested for showed trace concentrations and no detectable reduction.

TABLE 1

| | | Carbon A | | | |
|---|---|---|---|---|---|
| | Grams | (c) Remaining | | Mg | |
| pH | Carbon (m) | mg/l | mg | Adsorbed (x) | $\frac{x}{m}$ |
| 9.2 | Control | 30.0 | 15.0 | | |
| 9.2 | 0.05 | 24.0 | 12.0 | 3.0 | 60.0 |
| 9.2 | 0.10 | 20.5 | 10.3 | 4.7 | 47.0 |
| 9.2 | 0.50 | 12.5 | 6.3 | 8.2 | 17.4 |
| 9.2 | 1.00 | 8.5 | 4.3 | 10.7 | 10.7 |
| 9.2 | 5.00 | 4.5 | 2.3 | 12.7 | 2.5 |

$\frac{(X)}{(M)}$ $c_o$ = 94.8 mg./g.
Corr. Coeff. 0.997

TABLE 2

| | | Carbon B | | | |
|---|---|---|---|---|---|
| | Grams | (c) Remaining | | Mg | |
| pH | Carbon (m) | mg/l | mg | Adsorbed (x) | $\frac{x}{m}$ |
| 9.2 | Control | 30.0 | 15.0 | | |
| 9.2 | 0.05 | 18.5 | 9.3 | 5.7 | 114.0 |
| 9.2 | 0.10 | 17.5 | 8.8 | 6.2 | 62.0 |
| 9.2 | 0.50 | 8.0 | 4.0 | 11.0 | 22.0 |
| 9.2 | 1.00 | 6.5 | 3.3 | 11.7 | 11.7 |
| 9.1 | 5.00 | 3.5 | 1.8 | 13.2 | 2.6 |

$\frac{(X)}{(M)}$ $c_o$ = 263.6 mg./g.
Corr. Coeff. 0.987

TABLE 3

| Analysis | Leachate | Leachate Carbon Treated* | |
|---|---|---|---|
| Identification | Raw | A | B |
| pH | 9.10 | 9.20 | 9.10 |
| TOC mg/l | 30.00 | — | — |
| SOC mg/l | 30.00 | 4.50 | 3.50 |
| MO mg/l | 55.00 | 55.00 | 55.00 |
| AS mg/l | <0.01 | <0.01 | <0.01 |
| Se mg/l | 2.20 | 1.00 | 1.00 |
| V mg/l | <0.20 | <0.20 | <0.20 |
| U mg/l | 34.90 | 35.10 | 33.80 |
| Pb mg/l | <0.05 | <0.05 | <0.05 |
| Mn mg/l | <0.05 | <0.05 | <0.05 |
| Chloride mg/l | 6.00 | — | — |
| Dissolved Solids mg/l | — | — | — |
| Conductivity umhos/cm | 3,500 | — | — |

*Carbon treated (1 gm./100 ml.)

Table 4 shows the pore size distribution of a prior art activated carbon (Carbon A) and representative activated carbons of the present invention (Carbons B, C and D). The pore size distributions are determined by standard techniques using a Model 900/910 Series Mercury Porosimeter.

TABLE 4

| Carbon | Surface Area $m^2/g$ | Total Pore Volume cc/g | Pore Volume <1000Å cc/g | Pore Volume <100Å cc/g | Pore Volume <35Å cc/g | Pore Volume Diameter 35 to 1000Å cc/g |
|---|---|---|---|---|---|---|
| A | 1133 | 0.820 | 0.54 | 0.42 | 0.34 | 0.20 |
| B | 1329 | 1.247 | 0.85 | 0.56 | 0.36 | 0.49 |
| C | 1209 | 1.186 | 0.80 | 0.57 | 0.36 | 0.44 |
| D | 1085 | 0.996 | 0.70 | 0.48 | 0.30 | 0.40 |

Examples of such activated carbons are well known in the art, but the preferred activated carbon is prepared as follows:

To prepare the activated carbon of this invention, a charred carbonaceous material is pulverized to a mesh size wherein at least 60 percent of the pulverized material will pass through a 325 mesh screen (U.S. Standard). The pulverized material then is mixed with about 6 to 10 percent by weight of pitch or other carbonaceous binder, which is also pulverized, and the mixture is agglomerated or formed by compression into shapes, which, in turn, are crushed and screened to a mesh of about 4×12 (U.S. Standard).

The granular material thus obtained then is air oxidized at a temperature of from 200° F. to 900° F. for a period of 240 to 360 minutes. Air is introduced into the oxidation zone in accordance with the teachings of the prior art. The material so baked is then activated by steam at temperatures ranging from 1750° F. to 1850° F., preferably at 1800° F. to 1825° F. The duration of activation is governed by the activity of the final product desired.

A generally preferred preparation of the feed material may be described as follows. The raw coal material first is pulverized to 75 percent less than 325 mesh. Then 9 percent by weight pitch is added in the pulverizer. The mixture is then briquetted or agglomerated and subsequently crushed to a granular mesh of about 4×12. This material then is activated by the method described above.

A detailed illustrative example of the preparation of the activated carbon for treatment of phosphoric acid is as follows:

EXAMPLE 1

One hundred parts of a bituminous coal containing ash, 25 percent to 35 percent volatile material (VM), and 3 percent to 8 percent moisture was mixed with 9 parts of coal tar pitch having a softening range of 80° C. to 115° C. and was pulverized until the product contained about 75 percent that passed through 325 mesh U.S. Standard Sieve. The material was briquetted, crushed, and sized to 4×12 mesh (U.S.S.) granules. The sized material was oxidized/calcined by air at temperatures between 300° F. to 900° F. for a total of 240 minutes. The baked material was then activated at 1820° F. in an atmosphere containing 40 percent to 60 percent water vapor and carbon dioxide and the balance nitrogen. The activation of the oxidized/calcined material was conducted in a multiple hearth furnace where the effective exposure of carbon to activating gases were controlled between 240 and 300 minutes by adjusting the carbon feed rate and the furnace shaft speed. The material discharging from the furnace was cooled and crushed to yield (6×16) mesh granular product. Properties of the coal as it went through the process is shown below:

| | Oxidation/ Calcination | Activation |
|---|---|---|
| Active Density, g/cc | 0.7–0.75 | 0.35 |
| Volatile Matter, Percent/Weight | 16 | 0 |

We claim:

1. A process for selectively removing dissolved organic components from a uranium leachate solution which comprises passing said leachate solution through a bed of granular activated carbon wherein the activated carbon has a net pore volume of at least 0.40 cc/g for those pores having a pore diameter of from 35 to about 1000 Å.

* * * * *